United States Patent [19]

Ikegawa et al.

[11] 4,384,831

[45] May 24, 1983

[54] SCROLL-TYPE FLUID APPARATUS PROVIDED WITH MEANS FOR COUNTERACTING A MOMENT EXERTED ON ORBITING SCROLL MEMBER

[75] Inventors: Masato Ikegawa; Masaya Imai; Kenji Tojo; Masao Shiibayashi, all of Ibaraki, Japan

[73] Assignee: Hitachi, Ltd., Tokyo, Japan

[21] Appl. No.: 149,991

[22] Filed: May 15, 1980

[30] Foreign Application Priority Data

May 28, 1979 [JP] Japan ..... 54-65053

[51] Int. Cl.[3] ..... F01C 1/02; F01C 21/00

[52] U.S. Cl. ..... 418/55; 418/57; 418/71; 418/72; 418/77; 418/99

[58] Field of Search ..... 418/55, 57, 59, 71, 418/72, 76, 77, 80, 99

[56] References Cited

U.S. PATENT DOCUMENTS

| | | | |
|---|---|---|---|
| 3,924,977 | 12/1975 | McCullough | 418/55 |
| 3,994,633 | 11/1976 | Shaffer | 418/99 |
| 4,065,279 | 12/1977 | McCullough | 418/55 |
| 4,129,405 | 12/1978 | McCullough | 418/55 |
| 4,350,479 | 9/1982 | Tojo et al. | 418/55 |

*Primary Examiner*—John J. Vrablik

*Attorney, Agent, or Firm*—Antonelli, Terry & Wands

[57] ABSTRACT

A scroll-type fluid apparatus including an orbiting scroll member, a stationary scroll member, and a plurality of pockets formed in at least one of the orbiting scroll member and the stationary scroll member to cooperate with the other scroll member for confining liquid therein. When an axially urging force is ecerted on the orbiting scroll member, a liquid pressure commensurate with the axially urging force is produced in the pockets, so that such liquid pressure cancels out a biased axially urging force (moment) exerted on the orbiting scroll member.

14 Claims, 30 Drawing Figures

SCROLL-TYPE FLUID APPARATUS PROVIDED WITH MEANS FOR COUNTERACTING A MOMENT EXERTED ON ORBITING SCROLL MEMBER

BACKGROUND OF THE INVENTION

1. Field of the Invention

This invention relates to a scroll-type fluid apparatus suitable for use as a gas compressor, gas expander or liquid pump for raising the pressure of air, gas or refrigerant.

2. Description of the Prior Art

Scroll-type fluid apparatus generally including scroll-type compressors, expanders and pumps are well known to those skilled in the art.

Generally, such scroll-type fluid apparatus comprises two scroll members juxtaposed against each other, with each scroll member including an end plate and an involute or spiral wrap disposed in upright position on the end plate. Means, generally referred to as Oldham's ring, are provided for preventing use of the two scroll members from rotating on its own axis, with such means being interposed between the two scroll members so that the one scroll member may move in orbiting motion without rotating on its own axis while the other scroll member remains stationary. The stationary scroll member has a high pressure port formed in the center of its end plate, which port serves as an outlet port when the apparatus functions as a compressor and pump and as an inlet port for the working fluid for producing power when the apparatus is used as an expander. The stationary scroll member is also formed with a low pressure port which is disposed outwardly of the wrap. A fluid pressure is applied to the back (on a side of the end plate opposite the wrap) of the orbiting scroll member, to prevent the two scroll members from moving away from each other.

The pressure of the fluid confined between the two scroll members acts on a point which has a height of one half a height of the wraps, and a force causing one of the scroll members to move in orbiting motion (when the apparatus functions as a compressor and pump) and a load (when it functions as an expander) act on a power transmission between the orbiting scroll member and a crank shaft. The power transmission is disposed on a side of the end plate of the orbiting scroll member opposite the wrap, so that this point is axially spaced apart from the point on which the pressure of the fluid acts and the forces acting on these two points are oriented in opposite directions. Thus, a moment is exerted on the orbiting scroll member and strong local forces urge the orbiting scroll member against the fixed or stationary scroll member.

As the orbiting scroll member is pressed locally with a strong force, the problem of wear caused on the contacting sliding surfaces of the two scroll members is raised. Also, there is a loss of power due to friction increases. Since the two scroll members are not maintained in intimate contact with each other on the entire contacting sliding surfaces and they are in contact with each other locally, no satisfactory seal can be provided to the high pressure port side, the low pressure port side, and between working chambers.

Meanwhile the pressure of the fluid confined between the two scroll members may give rise to a force which tends to urge the two scroll members axially away from each other. U.S. Pat. No. 4,065,279 granted prior to the filing of this application discloses a hydrodynamic thrust bearing intended to bear this force.

It is noted, however, that no reference is made in U.S. Pat. No. 4,065,279 to the fact that the force urging the scroll members against one another becomes locally high or that the urging force becomes biased, nor is there any disclosure of means for solving these problems.

SUMMARY OF THE INVENTION

An object of the present invention is to counteract or relieve a moment exerted on the orbiting scroll member of a scroll-type fluid apparatus.

Another object is to provide a scroll-type fluid apparatus wherein its orbiting scroll member moves in orbiting motion while being maintained in intimate contact with its stationary scroll member, to minimize leakage of the fluid.

Still another object is to provide a scroll-type fluid apparatus wherein a frictional loss caused by the sliding movements of the two scroll members can be minimized.

Still another object is to provide a scroll-type fluid apparatus having a high ratio of output to input or high efficiency.

A further object is to provide a scroll-type fluid apparatus wherein wear caused on the contacting sliding surfaces of the scroll members can be minimized.

The outstanding characteristic of the invention is that, to accomplish the aforesaid objects, at least one of the two scroll members is provided with pocket means cooperating with the other scroll member to confine the liquid therein. By this arrangement, when an axially urging force is exerted on the orbiting scroll member, a liquid pressure, commensurate with the axially urging force in magnitude, is produced in the pocket means, so that the axial urging force which might otherwise act locally can be counteracted in its major portion. To counteract the axial urging force, the pocket means preferably comprises a plurality of pockets located peripherally of the scroll member.

DESCRIPTION OF THE PREFERRED EMBODIMENTS

Figure 1:
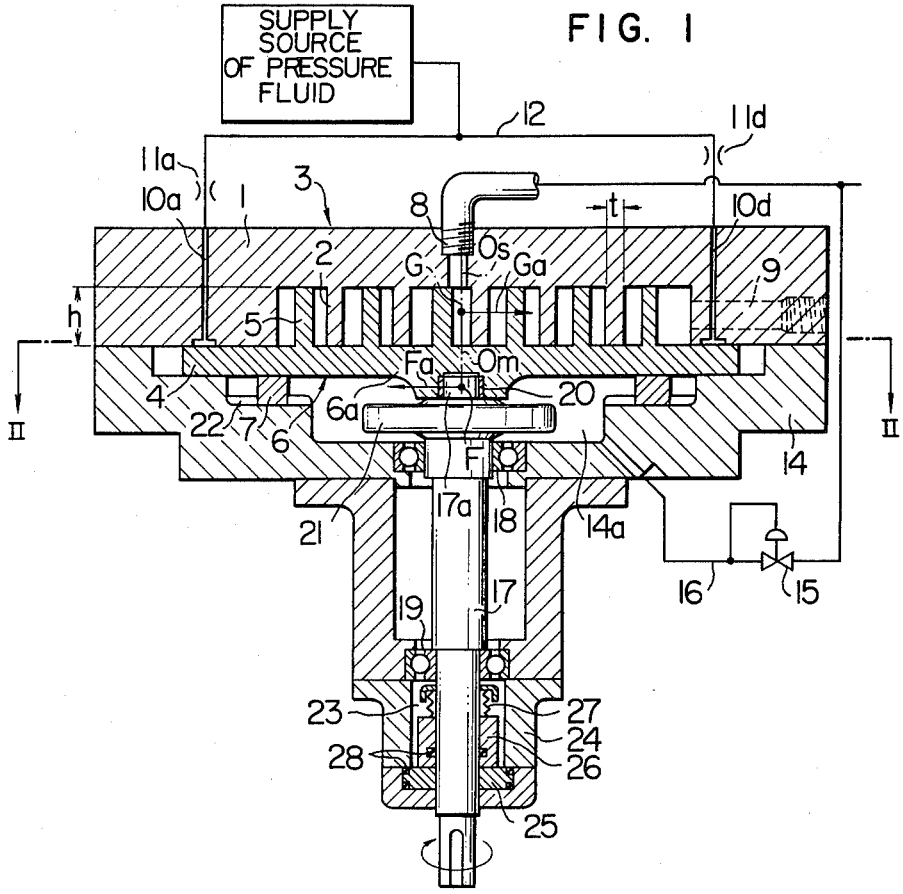
FIG. 1 is a vertical sectional view of the scroll-type fluid apparatus comprising a first embodiment of the invention.

A scroll-type compressor, a scroll-type expander and a scroll-type pump are substantially simlar to one another in basic construction, so that a scroll-type compressor will be described as an example in the following description.

FIGS. 1–4 show a first embodiment of the invention. A stationary scroll member generally designated by the reference numeral 3 comprises a disc-shaped end plate 1 and spiral wraps 2 having an involute curve or similar shape, a uniform thickness t and a uniform height h, and extending upright from the end plate 1. The stationary scroll member 3 is formed at its center portion with an outlet port (high pressure port) 8 and at its peripheral portion with an inlet port (low pressure port) 9. The stationary scroll member 3 includes, as shown most clearly in FIG. 2, a plurality of, for example, six oil supply passages 10 (10*a*, 10*b*, 10*c* . . . ) and six oil pockets 13 (13*a*, 13*b*, 13*c* . . . ) which are located circumferentially equiangularly and equidistantly from the center $O_s$ of the scroll member 3. The oil pockets 13 (13*a*, 13*b*, 13*c* . . . ) are arranged such that the spacing between adjacent pockets is equal to or less than twice the distance $O_s$-$O_m$ (hereinafter referred to as orbit radius $\epsilon$) wherein $O_s$ is the center of the scroll member 3 and $O_m$ is the center line of the orbiting scroll member 6.

These oil supply passages 10 (10*a*, 10*b*, 10*c* . . . ) are respectively connected to a common oil supply conduit 12 via throttles 11 (11*a*, 11*b*, 11*c* . . . ). The oil supply conduit 12 is connected to a supply source of pressurized fluid such as an oil feed pump.

An orbiting scroll member generally designated by the reference numeral 6 comprises a disc-shaped end plate 4, spiral wraps 5, having the same shape and size as the wraps 2 of the stationary scroll member 3 and extending upright from the end plate 4, and a scroll boss 6*a* provided on the opposite surface, hereinafter referred to as a back surface, of the end plate 4 to the wraps 5. The scroll boss 6*a* has its center $O_m$ disposed on the center line of the orbiting scroll member 6.

Figure 2:
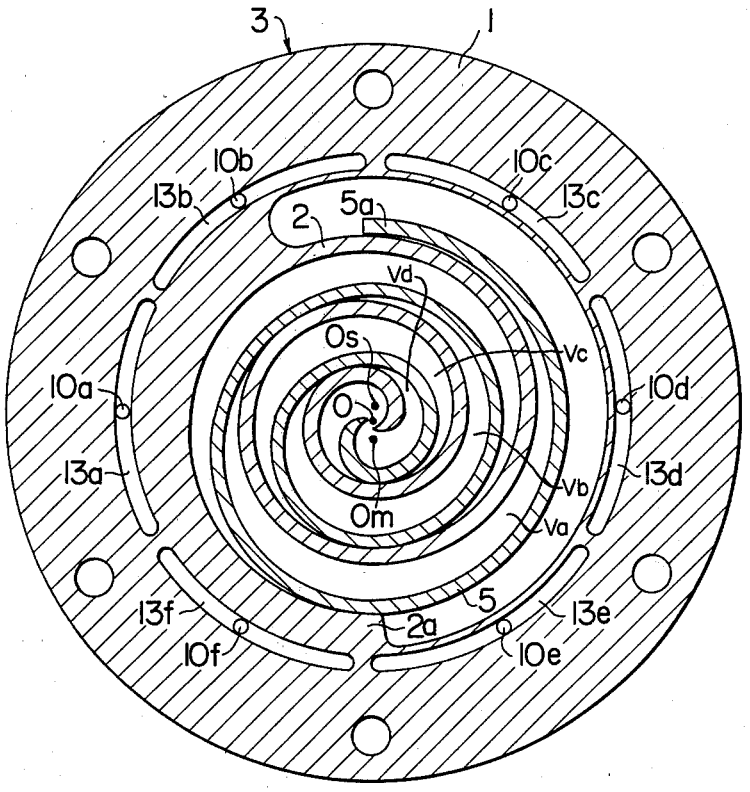
FIG. 2 is a sectional view taken along the line II—II in FIG. 1.
Figure 4A:
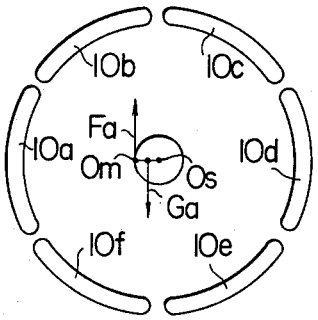
FIGS. 4*a*, 4*b*, 4*c* and 4*d* are views in explanation of the position on which the biased urging force is exerted.
Figure 4B:
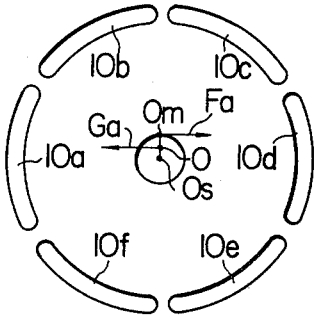
Figure 4C:
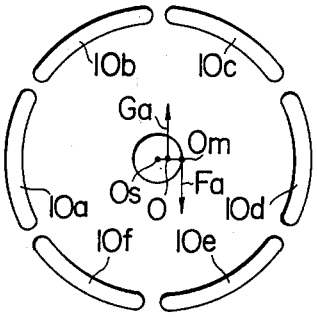
Figure 4D:
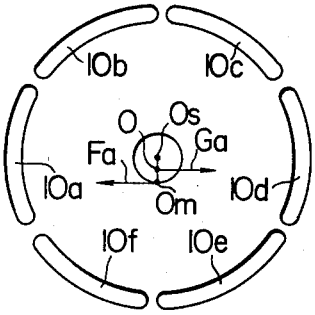

The stationary scroll member 3 and orbiting scroll member 6 engage with each other such that the wraps 2 and 5 face each other and, as shown in FIG. 2, a spiral end 2*a* of the wraps 2 and a spiral end 5*a* of the wraps 6 are symmetrical about a point O lying midway between the centers $O_m$ and $O_s$.

A frame 14 is secured by a plurality of bolts to the surface of the stationary scroll member 3 on which the wraps are disposed, and is formed, on its side facing the stationary scroll member 3, with a recess 14*a* which is communicated with the outlet port 8 through a conduit 16 mounting a pressure reducing valve 15.

A crank shaft 17 is rotatably supported by bearings 18 and 19 secured to the frame 14 and a longitudinal center axis coincides with the center $O_s$ of the stationary scroll member 3. The crank shaft 17 is provided at its end portion with a crank pin 17*a* having its center spaced apart from the center axis of the crank shaft 17 a distance corresponding to the orbit radius $\epsilon$. The crank pin 17*a* is fitted in the scroll boss 6*a* with a bearing 20 interposed between the crank pin 17*a* and the scroll boss 6*a*.

A balance weight 21 is attached to the crank shaft 17.

Figure 3:
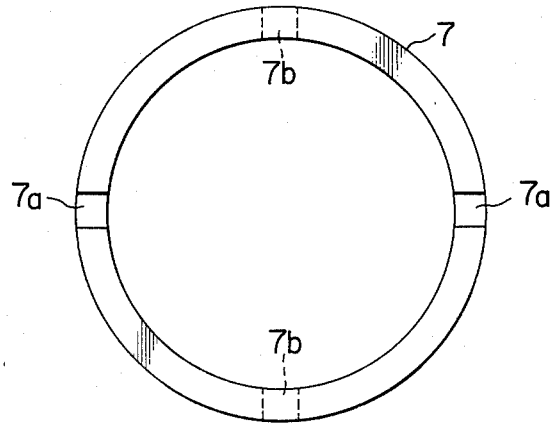
FIG. 3 is a front view of the Oldham's ring.

As shown in FIG. 3, an Oldham's ring 7 is formed on its one surface with grooves 7*a* and on the other surface with grooves 7*b* which are located transversely to the grooves 7*a*. The ring 7, as shown in FIG. 1, is interposed between the frame 14 and the back surface of the orbiting scroll member 6. The grooves 7*a* of the Oldham's ring 7 are fitted with Oldham's keys 22 secured to the frame 14, and the grooves 7*b* are fitted with Oldham's keys (not shown) secured to the back surface of the orbiting scroll member 6.

A mechanical seal 23, contained in a housing 24 secured to the frame 14 and, comprises a seal ring 25 secured to the housing 14, a floating ring 26 movably fitted on the crank shaft 17, a spring 27 for urging the floating ring 26 against the seal ring 25, and O-rings 28 achieving an airtight sealing between the housing 24 and seal ring 25 and between the crank shaft 17 and floating ring 26.

Operation of the embodiment shown in FIG. 1 will now be described. Operation of the scroll-type fluid apparatus in performing compression of the fluid ill be omitted, and the action of the apparatus for counteracting a locally strong urging force (hereinafter referred to as biased urging force) exerted on the orbiting scroll member 6 will be described. Lubricant is supplied under pressure through the oil supply conduit 12 to the throttles 11*a*, 11*b*, 11*c* . . . . After passing through the throttles 11*a*, 11*b*, 11*c* . . . , the lubricant is delivered to the oil pockets 13*a*, 13*b*, 13*c* . . . , via the oil supply passages 10*a*, 10*b*, 10*c* . . . respectively, so that the oil pockets 13*a*, 13*b*, 13 *c* . . . are filled with the lubricant.

As shown in FIGS. 1 and 4*a* to 4*d*, a force $F_a$ tending to cause the orbiting scroll member 6 to be orbited or to compress the fluid acts along the center $O_m$ of the orbiting scroll member 6, and a force $G_a$ tending to prevent compression of the fluid (that is, gas pressure in closed spaces Va, Vb, . . . ) acts on the point O disposed equidistantly from the centers $O_s$ and $O_m$ on the line connecting them. As for the axial direction, the force $F_a$ acts on a point F disposed at the middle of the axial extension of the crank pin 17*a* and the scroll boss 6*a*, and the force $G_a$ acts on a point G at a level of half the height of the wraps 5 of the orbiting scroll member 6.

The points at which the forces $F_a$ and $G_a$ respectively act are axially spaced apart from each other so that a moment, in a clockwise direction in FIG. 1, is applied on the orbiting scroll member 6. Meanwhile, a gas pressure of an intermediate pressure level is applied to the back surface of the orbiting scroll member 6 to force the same against the stationary scroll member 3 in order to achieve sealing of the forward ends of the two scroll wraps 2, 5. Thus, when the above-noted moment acts, a force of a greater magnitude is exerted on a bearing surface portion and a left side of the end plate 1 of the stationary scroll member 3 and a force of a smaller magnitude is exerted on a bearing surface portion on the right side of the end plate 1 of the stationary member 3 in FIG. 1. Stated differently, viewed peripherally, no uniform force is exerted on the bearing surface of the end plate 1 but rather a biased urging force is effective on the bearing surfaces.

Figure 9:
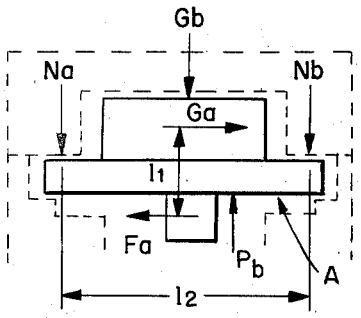
FIG. 9 is a schematic view of an orbiting scroll member of a scroll-type fluid apparatus depicting forces acting thereon.

More particularly, as shown in FIG. 9, from a balance of axial forces applying on the second scroll member, the following relationship may be obtained:

$$P_b \cdot A = N_a + N_b + G_b \quad (1)$$

Wherein:

$P_b$ equals a mean gas pressure acting on the back surface of the second scroll member;

A = total area of the end plate of the second scroll member;

$N_a$, $N_b$ = the urging forces supported by a bearing surface of the stationary scroll member; and $G_b$ = an axial component of gas forces caused by gas pressures in the closed spaces $V_a$, $V_b$ . . . .

From the balance of lateral forces, the following relationship exists:

$$F_a = G_a, \quad (2)$$

Wherein:

$F_a$ = a driving force;

$G_a$ = a lateral component of gas forces caused by the gas pressures in the closed spaces $V_a$, $V_b$ . . . .

From the balance of moment, the following relationship exists:

$$G_a \cdot l_1 = (N_a - N_b) \cdot l_2 \quad (3)$$

Wherein:

$l_1$, $l_2$ = distances between the acting forces.

From equations (1)–(3), one can obtain the following relationships:

$$N_a = \tfrac{1}{2}(P_a \cdot A - G_b + (l_1/l_2)G_a), \text{ and} \quad (4)$$

$$N_b = \tfrac{1}{2}(P_a \cdot A - G_b - (l_1/l_2)G_a). \quad (5)$$

From equations (4) and (5), it can be seen that the following relationship exists:

$$N_a - N_b = (l_1/l_2)G_a. \quad (6)$$

If $l_1 = 0$ of the acting point F of the force $F_a$ coincides with the acting point G of the force $G_a$, no moment would occur so $N_a = N_b$ where the urging force is uniform. However, in conventional scroll fluid type apparatus, the distance $l_1$ cannot be 0 and, therefore, inevitably $N_a$ becomes greater than $N_b$ and therefore a biased urging force occurs.

Thus, the biased urging force acts only on an area bordering on the line passing through the center $O_m$ of the oribiting scroll member 6 and the center $O_s$ of the stationary scroll member 3 toward which area the force $F_a$ for orbiting the orbiting scroll member 6 is directed. The area on which the biased urging force is exerted is on the upper side of the center $O_s$ in FIG. 4*a*, on the right side thereof in FIG. 4*b*, on the lower side thereof in FIG. 4*c* on the left side thereof in FIG. 4*d*. The biased urging force revolves in the same direction in which the center $O_m$ of the orbiting scroll member 6 does. The oil contained in the oil pockets 13 is restricted by the throttles 11 from flowing backward from the oil pockets 13 to the oil supply source of pressure fluid, and the biased urging force is exerted on the orbiting scroll member 6. Thus, a hydraulic pressure corresponding with the biased urging force is produced in the oil pocket 13 which is disposed in an area exerted by the urging force. The hydraulic pressure thus produced keeps in equilibrium with the whole or part of the biased urging force balance to counteract the same.

Figure 10:
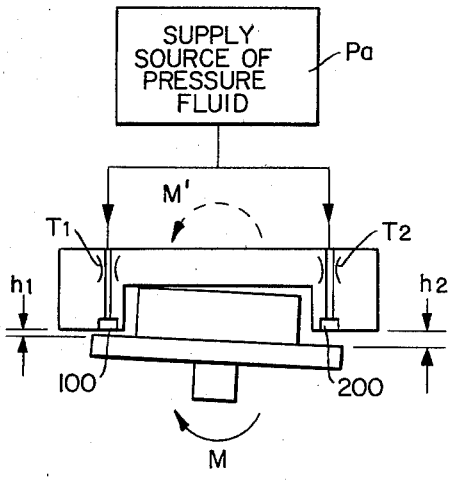
FIG. 10 is a schematic view of a scroll-type fluid apparatus depicting moments generated due to pressures in pockets of the apparatus.

FIG. 10 provides an illustration more clearly depicting the manner in which a change occurs in hydraulic pressure in the oil pocket 13 in accordance with the biased urging force. More particularly, as shown in FIG. 10, assuming the stationary or first scroll member is provided on the sliding bearing surface with pockets 100, 200, respectively having pocket pressures $P_{p1}$, $P_{p2}$, with the pressure of the supply source being $P_a$, and with the supply source being connected to the pockets 100, 200 throur throttles $T_1$, $T_2$, as noted above, a moment M is applied to the orbiting scroll member so that the orbiting scroll member is slightly tilted. Due to this tilting action by the orbiting scroll member, a gap $h_1$ at the pocket 100 less than a gap $h_2$ at the pocket 200.

Figure 11:
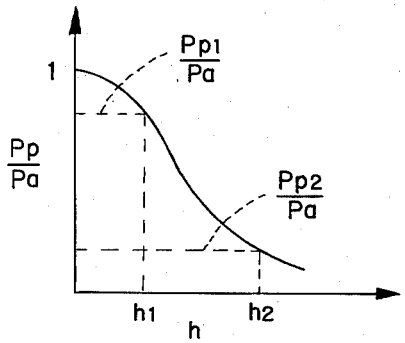
FIG. 11 is a graphical illustration depicting a relationship between pressure in pockets, of a scroll-type fluid apparatus and a gap between fixed and orbiting scroll members of the apparatus.
Figure 12:
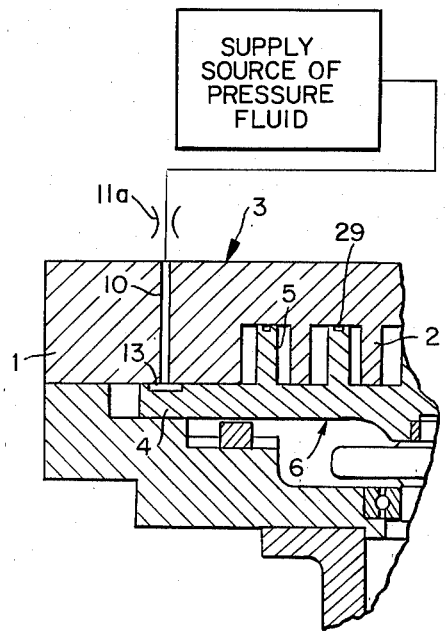
FIG. 12 is a partial cross sectional view of a scroll-type fluid apparatus constructed in accordance with another embodiment of the present invention.
Figure 13:
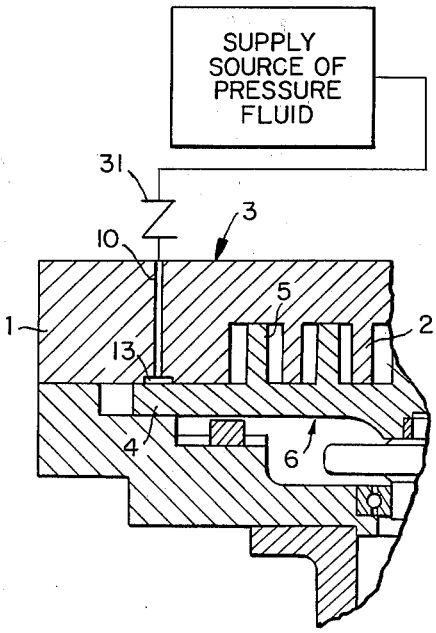
FIG. 13 is a partial cross sectional view of a scroll-type fluid apparatus constructed in accordance with a further embodiment of the present invention.
Figure 14:
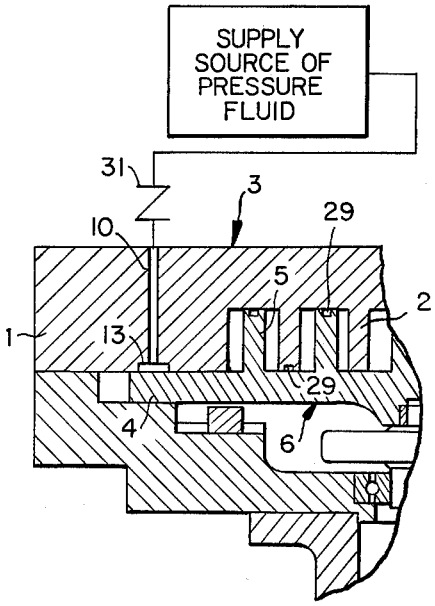
FIG. 14 is a partial cross sectional view of a scroll-type fluid apparatus constructed in accordance with a still further embodiment of the present invention.
Figure 15:
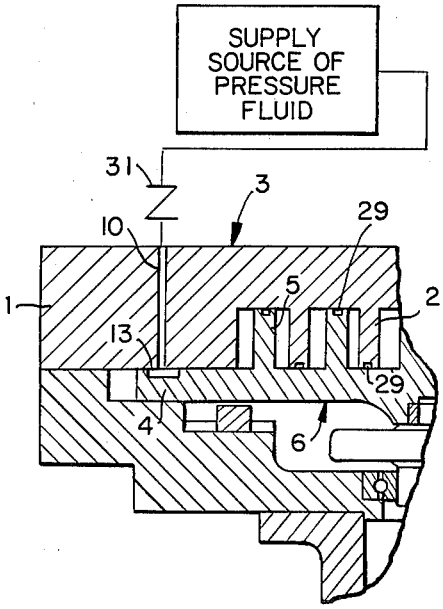
FIG. 15 is a partial cross sectional view of a scroll-type fluid apparatus constructed in accordance with yet another embodiment of the present invention.
Figure 16:
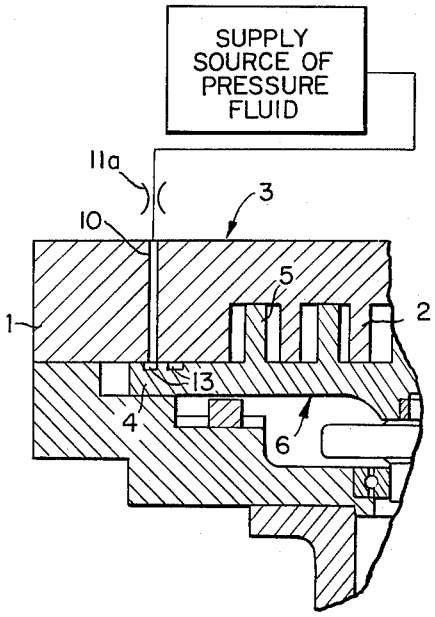
FIG. 16 is a partial cross sectional view of a scroll-type fluid apparatus constructed in accordance with a still further embodiment of the present invention.
Figure 17:
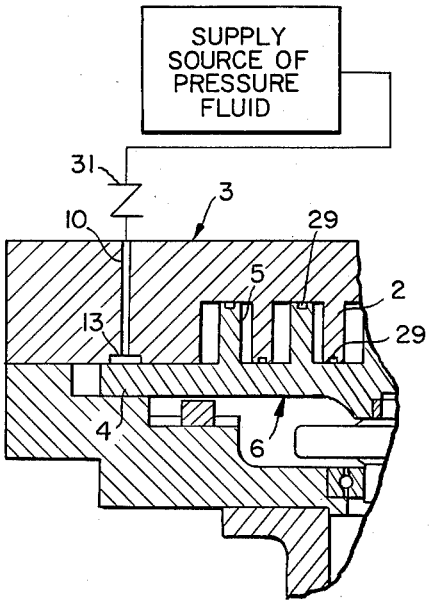
FIG. 17 is a partial cross sectional view of a scroll-type fluid apparatus constructed in accordance with another embodiment of the present invention.
Figure 18:
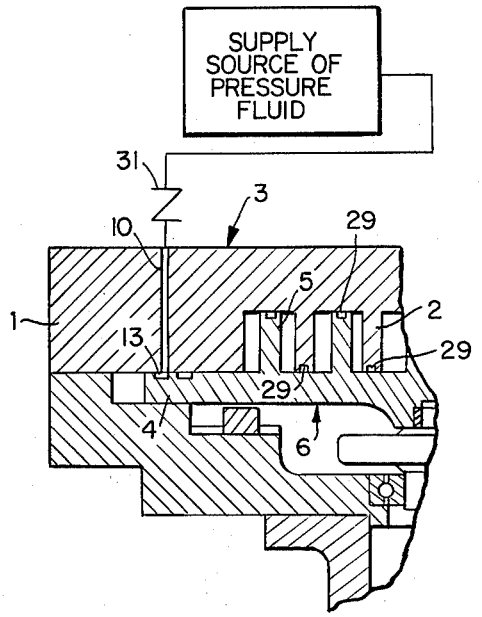
FIG. 18 is a partial cross sectional view of a scroll-type fluid apparatus constructed in accordance with a further embodiment of the present invention.
Figure 21:
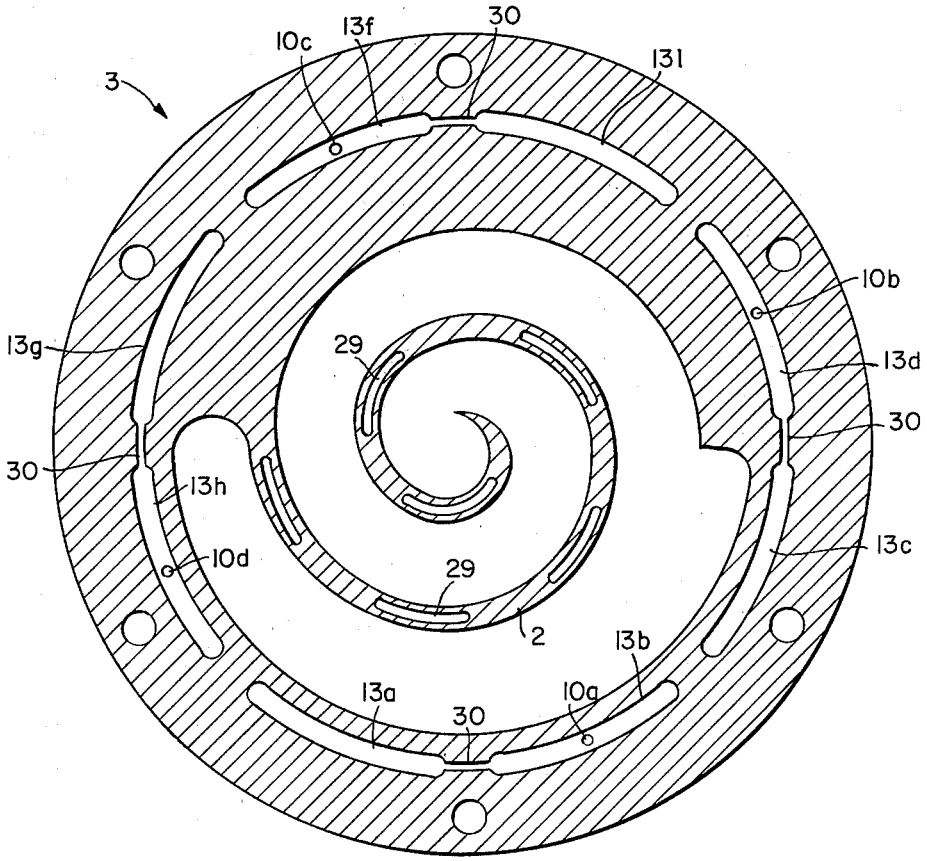
FIG. 21 is a cross sectional view of a stationary scroll member for a scroll-type fluid apparatus constructed in accordance with yet another embodiment of the present invention.
Figure 19:
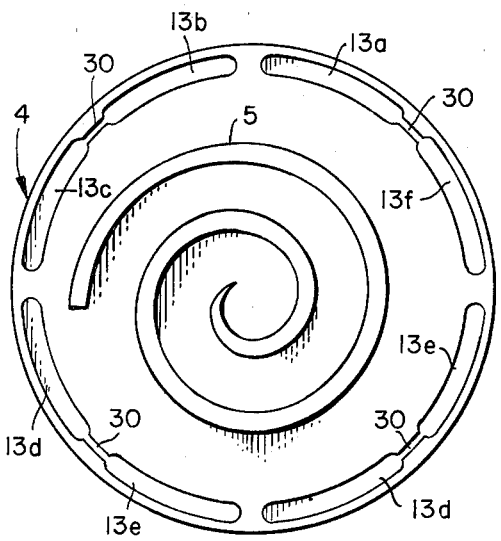
FIG. 19 is a plan view of an orbiting scroll member for a scroll-type fluid apparatus constructed in accordance with the present invention.
Figure 20:
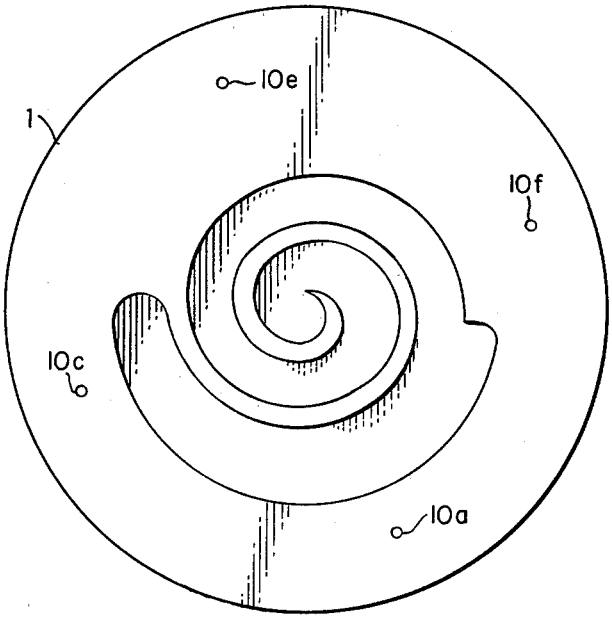
FIG. 20 is a plan view of a fixed scroll member for the scroll-type fluid apparatus of FIG. 19.
Figure 23:
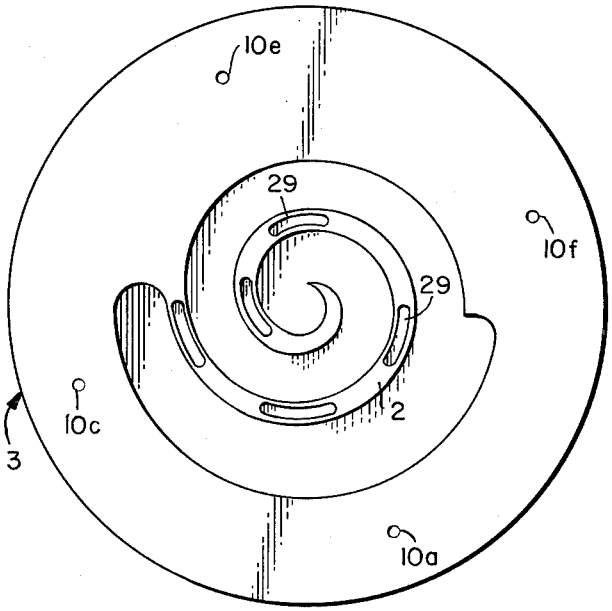
FIG. 23 is a plan view of a fixed scroll member for a scroll-type fluid apparatus of FIG. 22.
Figure 22:
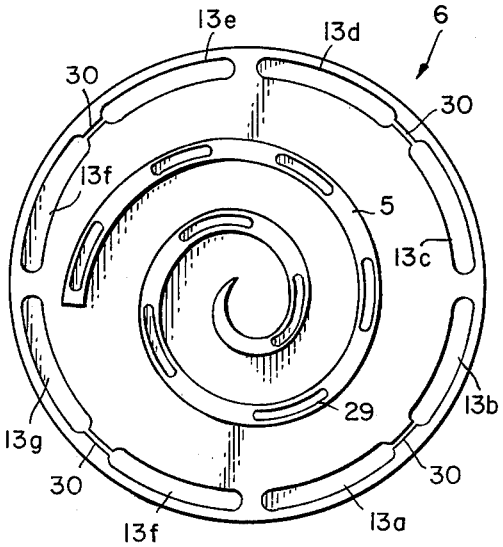
FIG. 22 is a plan view of an orbiting scroll member for a scroll-type fluid apparatus constructed in accordance with the present invention.

On the other hand, considering the theory of hydrostatic bearings, the pressure $P_p$ in the respective pockets has the relationship illustrated in FIG. 11. More particularly, as shown in FIG. 11, the pressure $P_{p1}$ in the pocket 100 is greater than the pressure $P_{p2}$ in the pocket 200. In otherwords, a high pressure is generated in pocket 100 where a large urging force is applied. While a low pressure is generated in the pocket 200 where a smaller urging force is applied. Consequently, what is generated in each pocket 100, 200 is a pressure corresponding to the urging force acting on the pocket. The pressures in the pocket apply a moment M' on the orbiting scroll member which would substantially balance the moment M.

Figure 5:
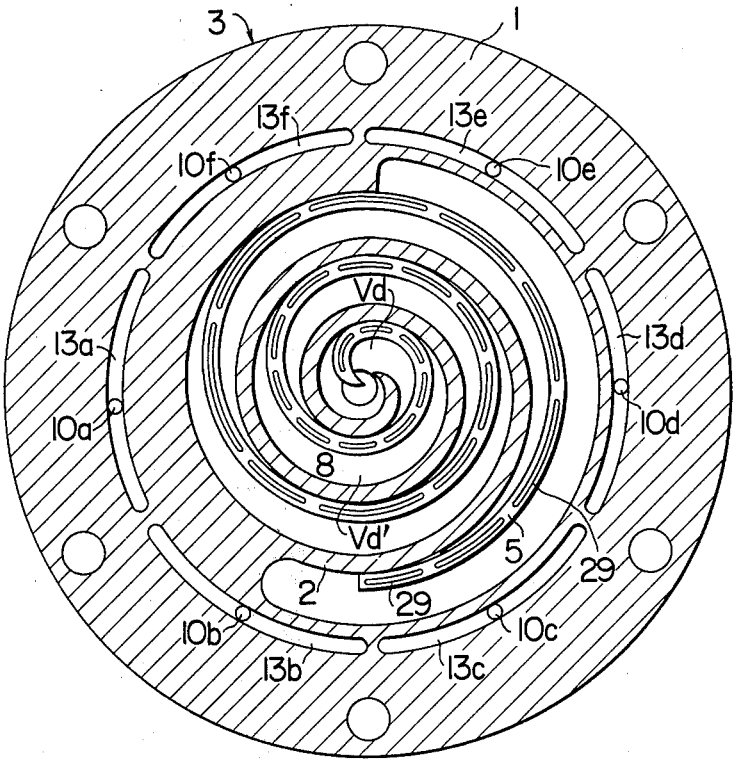
FIG. 5 is a vertical sectional view of the scroll-type fluid apparatus comprising a second embodiment of the invention.

FIG. 5 shows a second embodiment of the invention in which parts similar to those shown in FIGS. 1, 3 and 4 are designated by like reference numerals and their description is omitted.

The second embodiment is similar to the first embodiment except that the wrap 5 of the orbiting scroll member 6 is formed with oil grooves or recesses 29 along its sliding surface. While FIG. 5 shows only the oil grooves or or recesses 29 formed on the wraps 5 of the orbiting scroll member 6, as shown in FIGS. 12, 14, 15, 17, 18, 21, 22, and 23, the oil grooves or recesses 29, independent from one another, may be formed in large numbers at the sliding surfaces of either or both of the wraps 5, 2 of the orbiting scroll member 6 and stationary scroll member 3. Sucked gases or oil injected into the chamber in the course of compression are filled in the oil grooves or recesses 29 on the sliding end surfaces of the wraps 5 and 2 during operation of the compressor.

This has the effects of attaining good lubrication on the sliding surfaces of the wraps 5 and 2 as well as effectively preventing gases from leaking from a closed space of high pressure, for example, closed space Vd, to a closed space of low pressure Vd' past the wraps 5 and 2.

Figure 6:
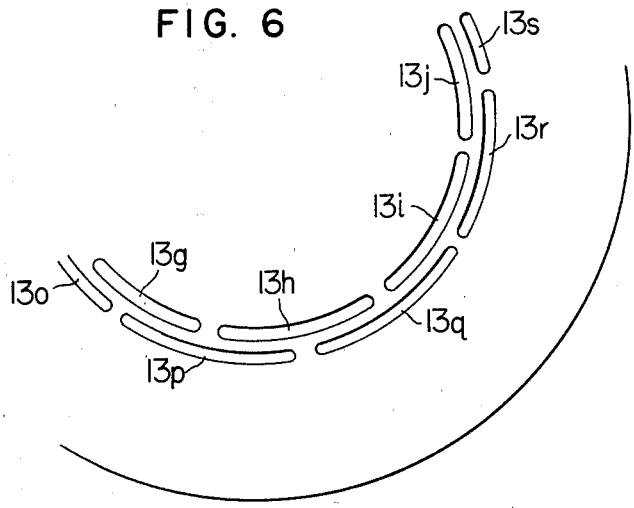
FIG. 6 is a sectional view, on an enlarged scale, of the essential portions of the scroll-type fluid apparatus comprising a third embodiment of the invention.
Figure 7:
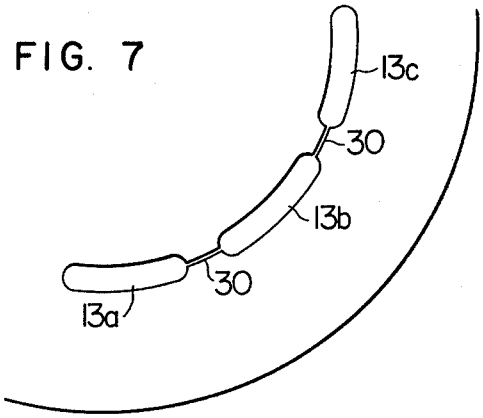
FIG. 7 is an enlarged view of the essential portions of the scroll-type fluid apparatus comprising a fourth embodiment of the invention.
Figure 8:
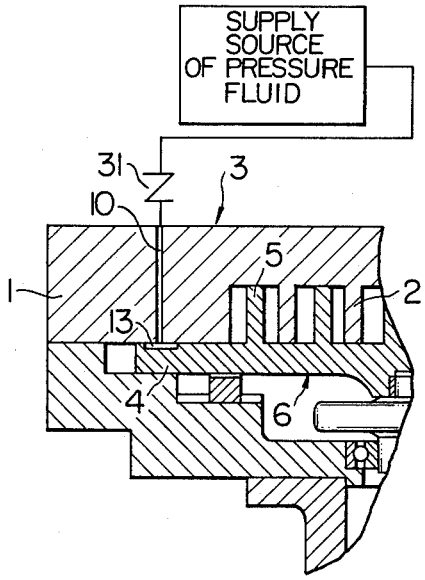
FIG. 8 is a sectional view of the essential portions of the scroll-type fluid apparatus comprising a fifth embodiment of the invention.
Figure 24:
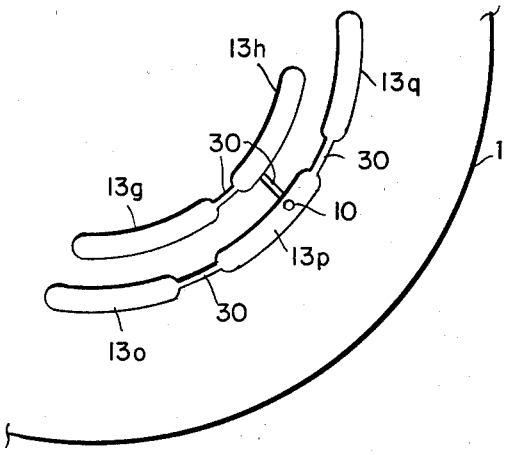
FIG. 24 is a partial plan view of a fixed scroll member for a scroll-type fluid apparatus constructed in accordance with a further embodiment of the present invention.
Figure 25:
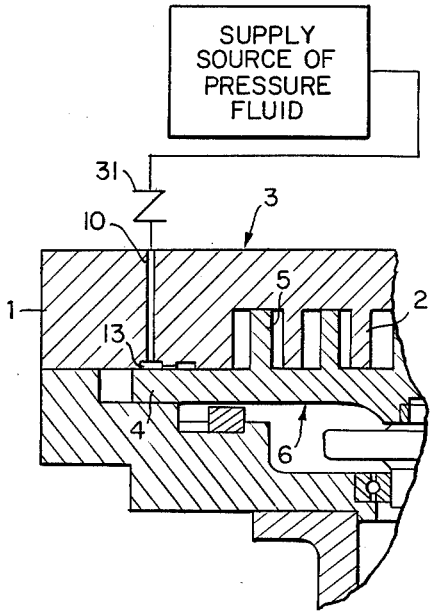
FIG. 25 is a partial cross sectional view of the orbiting a fixed scroll members of the scroll-type fluid apparatus of FIG. 24.

As shown in FIGS. 6, 24 and 25 the oil pockets 13 of the first embodiment may be arranged in two rows (which may be more than two rows). The oil pockets 13 comprises inner oil pockets 13*g*, 13*h*, 13*i*, 13*j* . . . and outer oil pockets 13 *o*, 13*p*, 13*q*, 13*r*, 13*s* . . . . The oil pockets 13 are arranged such that the spacing between the inner and outer pockets and the spacing between the adjacent pockets in the same row are less than twice the orbit radius $\epsilon$.

Each of the oil pockets 13 (13*a*, 13*b*, 13*c* . . . ) is associated with one of the oil supply passages 10. When the oil pockets are arranged in a plurality of rows, the number of the oil pockets 13 is increased. It is possible to reduce the number of the oil supply passages 10 by providing additional means as presently to be described hereinbelow in connection with further embodiments of the present invention.

Figure 26:
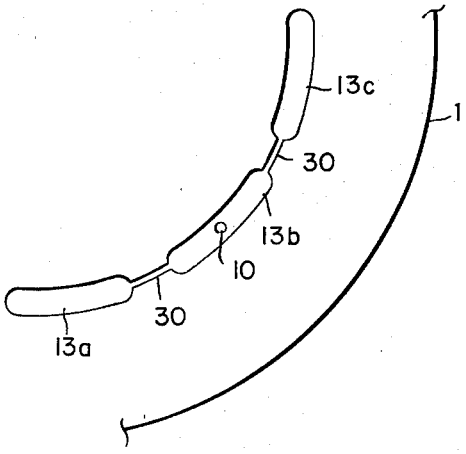
FIG. 26 is a partial plan view of a fixed scroll member of a scroll-type fluid apparatus constructed in accordance with yet another embodiment of the present invention.

In the embodiments shown in FIGS. 7, 19, 21, 22, and 24 passages 30 having a throttling action are used to connect together the oil pockets 13*a*, 13*b*, 13*c* . . . of the embodiments of FIGS. 1, 5 and 6. All the oil pockets 13*a*, 13*b*, 13*c* . . . may be connected together by connecting the adjacent oil pockets together by a passage 30. However, three pockets, for example, are preferably connected together as a group by the passages 30 and, as shown most clearly in FIGS. 24 and 26, the intermediate oil pocket alone is preferably connected to the oil supply passage 10. By dividing the oil pockets into a plurality of groups each group consisting of three oil pockets, it is possible not only to reduce the number of the oil supply passages 10 but also to supply from the intermediate oil pocket 13 associated with the oil supply passage 10 to the adjacent oil pockets 13 not associated with the oil supply passage 10 a necessary amount of oil (to compensate for the oil leaked from the pockets 13 when the urging force is exerted).

Figure 27:
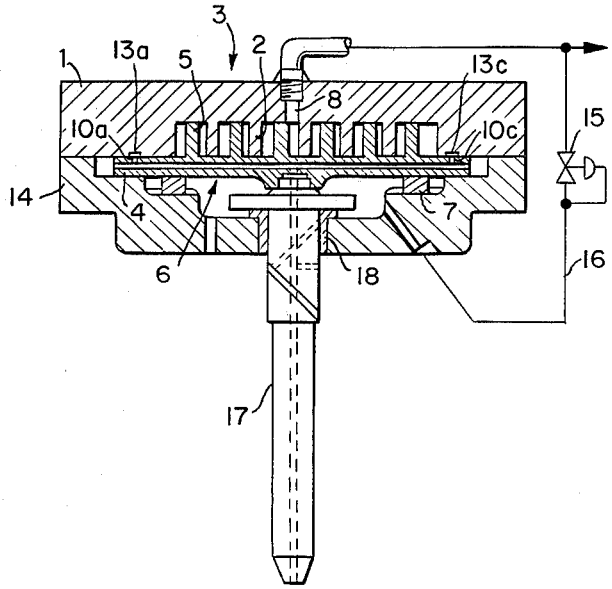
FIG. 27 is a partial cross sectional view of another embodiment of a scroll-type fluid apparatus in accordance with the present invention.

In the embodiments of FIGS. 1, 5, 7, 13, 14, 17, 21, 24, 25 and 26, the oil pockets 13 are formed in the stationary scroll member 3 alone. However, the invention is not limited to this arrangement and the oil pockets 13 may be formed in the orbiting scroll member 6 as shown in FIGS. 8, 12, 15, 16, 18, 19, 22. In this case, it is necessary to select the position and dimension (width) of the oil pockets 13 and the oil supply passages 10 in such a manner that they are maintained in communication with each other at all times. As shown in FIGS. 8, 13, 14, 15, 17, 18 and 25, each throttle 11 may be replaced by a check valve 31. In addition to that as shown in FIGS. 8, 12–18 and 25, the oil supply passages 10 may be formed only in the stationary scroll member 3. However, as shown in FIG. 27, the invention is not limited to this arrangement and the oil supply passage means may be formed in the orbiting scroll member 6 and a crankshaft 17.

From the foregoing description, it will be appreciated that the present invention enables, by providing oil pockets 13 on the sliding surfaces of the stationary scroll member 3 and/or the orbiting scroll member 6 of a scroll-type fluid apparatus, a pressure to be produced in those oil pockets 13 which are disposed in positions on which a biased urging force is exerted so that such pressure counteracts the whole or a part of the biased urging force acting between the orbiting scroll member 6 and the stationary scroll member 3. Thus, the invention has the effect of cancelling out or relieving a moment acting on the orbiting scroll member 6.

The objects of the invention described in the summary of the invention can be accomplished as a result of the cancelling out of the moment by the pressure produced in the oil pockets 13.

What is claimed is:

1. A scroll-type fluid apparatus comprising:

a first scroll member including an end plate and spiral wraps extending upright from said end plate;

a second scroll member including an end plate and spiral wraps extending upright from said end plate;

said first scroll member and said second scroll member being arranged in juxtaposed relationship with the wraps thereof being fitted closely together;

a rotation preventing member for preventing said second scroll member from rotating on its own axis;

frame means securedly connected to said first scroll member;

a crank shaft means rotatably supported by said frame means for rotation about a point coinciding with the center of said first scroll member and provided with an engaging means, said engaging means disposed at a point spaced apart from the center of its rotation by a distance corresponding to an orbit radius and for transmitting power between said scroll member and said crankshaft means;

low pressure port means formed in said end plate of said first scroll member at a position near to a terminal end of said spiral wrap;

high pressure port means formed in said end plate of said first scroll member in a position near to a beginning of said wrap;

a plurality of pockets formed on a sliding surface of one of said first scroll member and said second scroll member for confining liquid therein, said pockets being separated from each other and located on a peripheral position of said end plate outside of the wrap;

liquid supply passage means for supplying the liquid to each of said pockets;

means mounted in said liquid supply passage means for restricting the outflow of the liquid from each of said pockets via said supply passage means; and a source for supplying the liquid to each of said pockets.

2. A scroll-type fluid apparatus as claimed in claim 1, wherein said pockets and said liquid supply passage means are formed in said first scroll member.

3. A scroll-type fluid apparatus as claimed in claim 1, wherein said pockets are formed in said second scroll member and said liquid supply passage means is formed in said first scroll member.

4. A scroll-type fluid apparatus as claimed in claim 1, wherein recess means are provided for at least enhancing lubrication effects of sliding surfaces of the wraps, said recess means being formed in the wraps of said first and second scroll members, said pockets are formed in the end plate of said first scroll member, and said liquid supply passage means is formed in said first scroll member.

5. A scroll-type fluid apparatus as claimed in claim 1, wherein said pockets are formed in the end plate of said second scroll member, recess means are provided for at least enhancing lubrication effects of sliding surfaces of the wraps, said recess means being formed on end surfaces of the wraps of said first and second scroll members, and wherein said liquid supply passage means is formed in said first scroll member.

6. A scroll-type fluid apparatus as claimed in one of claims 2, 3, 4 or 5, wherein said means for restricting the outflow of the liquid from each pocket via said liquid supply passage means comprises throttles.

7. A scroll-type fluid apparatus as claimed in one of claims 2, 3, 4, or 5, wherein said means for restricting the outflow of the liquid from each of said pockets comprises check valve means for allowing the liquid to flow from said source of supply to each of said pockets but prevents the liquid from flowing out of each of said pockets toward said source of supply.

8. A scroll-type fluid apparatus as claimed in one of claims 2, 3, 4 or 5, wherein said pockets are arranged in at least two rows.

9. A scroll-type fluid apparatus as claimed in one of claims 2, 3, 4 or 5, wherein said pockets are connected together by passages having a throttling function.

10. A scroll-type fluid apparatus as claimed in claim 9 wherein said passages having a throttling function connect the pocket in the intermediate position to the adjacent pockets, said intermediate pocket being connected to said liquid supply passage means.

11. A scroll-type fluid apparatus as claimed in claim 1, wherein a plurality of recesses are formed on an end surface of a wrap of at least one of said first and second scroll members.

12. A scroll-type fluid apparatus as claimed in claim 11, wherein said recesses are formed in each of said first and second scroll members.

13. A scroll-type fluid apparatus as claimed in one of claims 1 or 2, characterized in that the number of pockets is at least six.

14. A scroll-type fluid apparatus as claimed in claim 1, wherein said liquid supply passage means is formed in said second scroll member.

* * * * *